United States Patent [19]

Sakaguchi

[11] 4,310,833

[45] Jan. 12, 1982

[54] ELECTRICALLY-ENERGIZED HORN

[75] Inventor: Mitsuo Sakaguchi, Tokyo, Japan

[73] Assignee: Kobishi America, Inc., Carson, Calif.

[21] Appl. No.: 112,297

[22] Filed: Jan. 15, 1980

[51] Int. Cl.[3] ..... G08B 3/00

[52] U.S. Cl. ..... 340/384 E; 340/63; 340/388

[58] Field of Search ..... 340/63, 65, 384 R, 384 E, 340/388, 527

[56] References Cited

U.S. PATENT DOCUMENTS

| | | | |
|---|---|---|---|
| 3,432,849 | 3/1969 | Earling | 340/388 |
| 3,890,612 | 6/1975 | Sweany et al. | 340/384 E |
| 3,931,549 | 1/1976 | Berns et al. | 340/384 E |
| 4,065,767 | 12/1977 | Neuhof et al. | 340/384 E |
| 4,195,284 | 3/1980 | Hampshire et al. | 340/388 |

*Primary Examiner*—Alvin H. Waring

*Attorney, Agent, or Firm*—Keith D. Beecher

[57] ABSTRACT

An electrically-energized horn is provided which is particularly suited for use in fire alarm and burglar alarm systems, and which includes a built-in solid state electronic drive circuit including a timer network for de-energizing the horn a predetermined time after it has been activated.

1 Claim, 4 Drawing Figures

ELECTRICALLY-ENERGIZED HORN

BACKGROUND

The invention is concerned with a horn in which sound is produced by a diaphragm set in rapid vibration by appropriate electromagnetic means, and in which the sound is amplified by an acoustic conduit. The horn of the invention has particular application in automatic fire and burglar alarm systems, as mentioned above. As also mentioned above, a feature of the horn of the invention is that it includes a self-contained solid state drive and cut-off circuit, so that it is merely necessary to connect the unit into an automatic alarm system, and the unit provides its own drive power and automatic cut-off.

A particular commercial embodiment of the horn of the invention has been constructed, and the constructed embodiment has a 12-volt direct current rating, and draws a maximum of 850 milliamps. The constructed unit develops a sound intensity of about 104 Db at 10 feet. The cut-off timer circuit in the constructed embodiment is timed to de-activate the horn automatically 300 seconds ±36 seconds after the unit has been activated. The foregoing specifications, of course, are given merely by way of example, and are not intended to limit the invention in any way.

DETAILED DESCRIPTION OF THE ILLUSTRATED EMBODIMENT

The horn of the invention includes, for example, a casing 10. The casing 10 has a tubular portion 10A adjacent to a first end, and it has an outwardly flared portion 10B extending towards its second end. The unit is supported on a stand 12 by means of brackets 14 and 16, the brackets being intercoupled by a bolt 18 which permits angular adjustment of the casing 10. The casing may be formed, for example, of a heat resistant polypropylene plastic.

Figure 3:
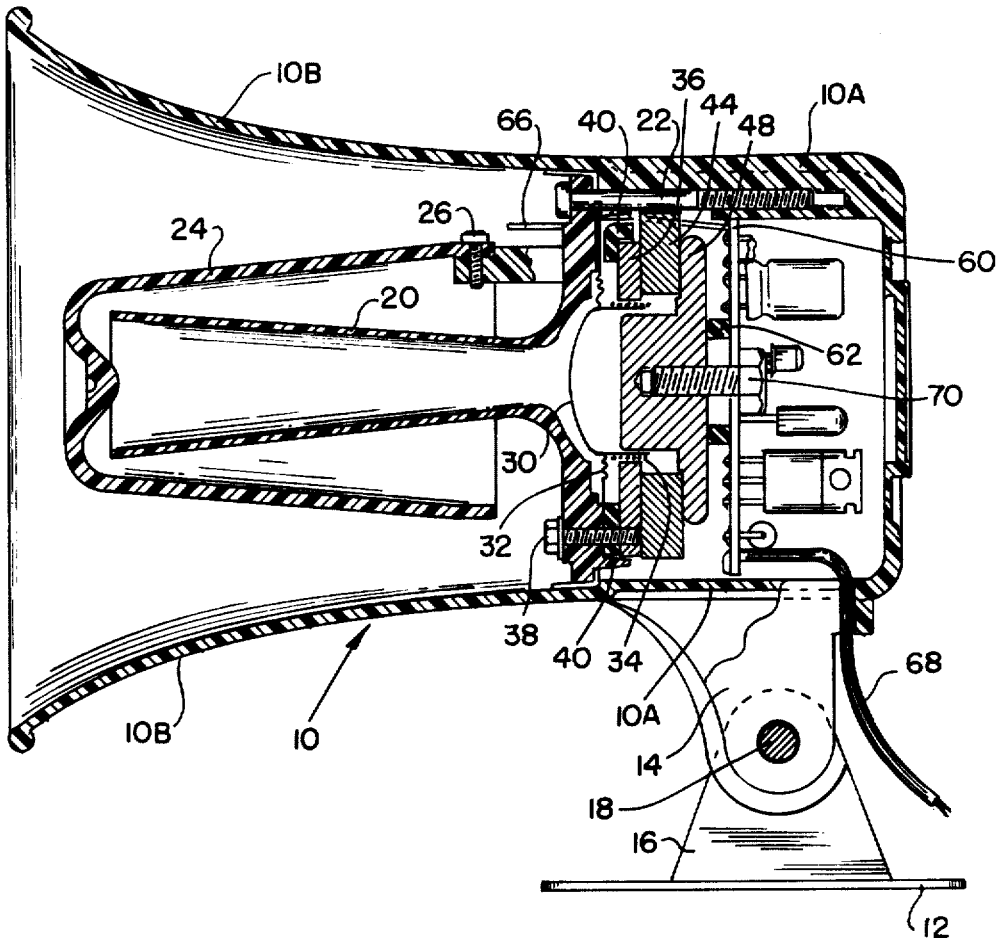
FIG. 3 is a section taken along the line 3—3 in FIG. 2, and on an enlarged scale with respect to the representations of FIGS. 1 and 2.

An acoustic conduit in the form of an elongated tubular nozzle 20 composed, for example, of nylon, is mounted to the tubular portion 10B of casing 10 by screws, such as screw 22. A horn 24 is mounted to the tubular portion 10B of casing 10 by means of screws, such as a screw 26. Horn 24 has the illustrated configuration in FIG. 3, and it is mounted coaxially with respect to the nozzle 20 and encloses the nozzle, as shown. The horn may, likewise be formed of a heat resistant polypropylene plastic.

A bobbin 30 formed, for example, of aluminum, is mounted within the tubular portion 10A of casing 10 adjacent to the throat of nozzle 20, the throat facing the first end of the casing, as shown. The bobbin is supported by a diaphragm 32, and it is capable of rapid reciprocal movement into and out of the throat of the nozzle, which movement creates a high piercing sound.

A coil 34 is wound around the bobbin 30. An annular plate 36 is mounted adjacent to coil 34, and the plate is held in place of screws such as screw 38. An insulating annular plate 40 is interposed between plate 36 and the end of nozzle 20, and the screws 38 extend through the end of the nozzle, as shown. Plate 36 is formed, for example, of cold rolled steel. The plate creates a magnetic field which causes coil 34 rapidly to vibrate diaphragm 30 in the throat of the nozzle when the coil is energized.

An annular plate 44 of magnetic material such as ferrite is mounted adjacent to the annular steel plate 36, and a further plate 48 formed of cold rolled steel is mounted on the other side of plate 44. Plate 44 extends into the bobbin 30 on the other side of coil 34 so as to complete the magnetic circuit.

Figure 1:
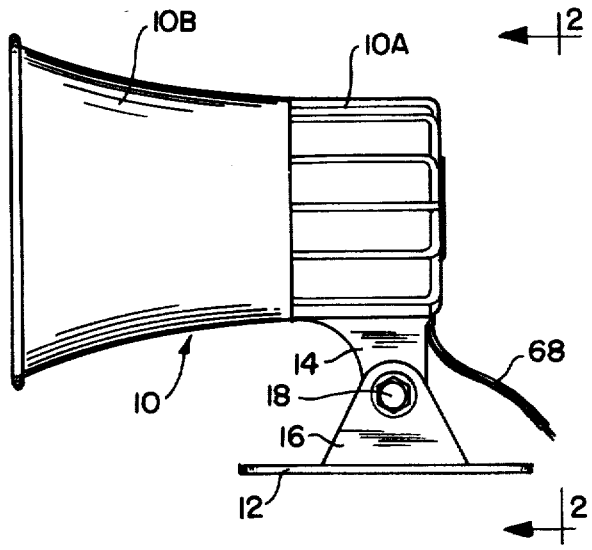
FIG. 1 is a side elevational view of a horn constructed in accordance with the concepts of the present invention.
Figure 2:
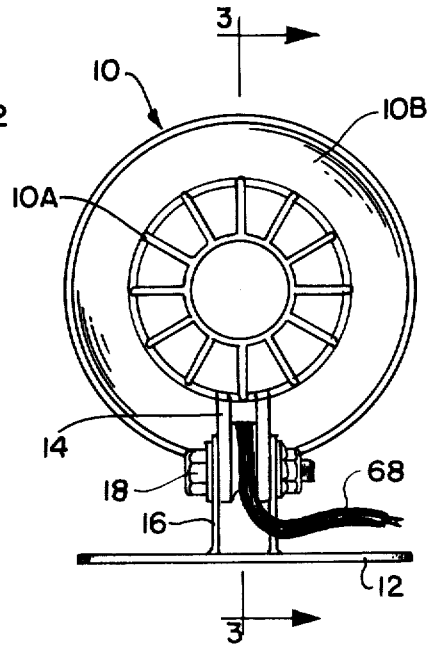
FIG. 2 is an end view of the unit taken from the right in FIG. 1.
Figure 4:
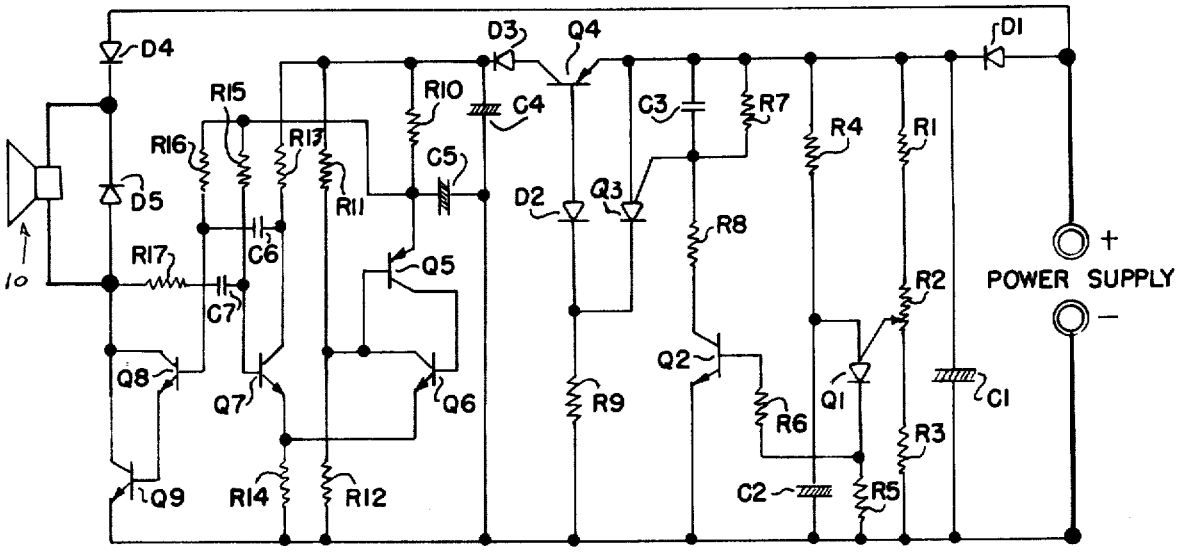
FIG. 4 is a schematic diagram of a solid state electronic circuit which is contained within the unit.

A printed circuit board 60 is mounted within the tubular portion 10A of casing 10 on a bushing 62 of insulated material, the bushing being interposed between plate 48 and the printed circuit board 60. An electronic circuit, which is shown in FIG. 4, and which includes solid state elements, is mounted on the printed circuit board 60, and the circuit is connected to the coil 34 through terminals, such as terminal 66. The circuit on circuit board 60 is energized by an electric cable 68 which connects the circuit to an appropriate power source which, in the case of the constructed embodiment is a 12-volt direct voltage source. The printed circuit board 60 is mounted on plate 48 by means of a screw 70 which extends coaxially with bushing 62, and which is threaded into plate 48.

The solid state electronic circuit mounted on printed circuit board 60 is shown in FIG. 4, and it includes the following elements, connected as shown:

| | |
|---|---|
| Resistor R1 | 20 kil-ohms |
| Potentiometer R2 | 50 kil-ohms |
| Resistor R3 | 30 kil-ohms |
| Resistor R4 | 2 megohms |
| Resistor R5 | 1 kil-ohm |
| Resistor R6 | 10 kilo-ohms |
| Resistor R7 | 10 kil-ohms |
| Resistor R8 | 10 kil-ohms |
| Resistor R9 | 10 kil-ohms |
| Resistor R10 | 510 ohms |
| Resistor R11 | 3.3 kilo-ohms |
| Resistor R12 | 4.7 kilo-ohms |
| Resistor R13 | 1 kil-ohm |
| Resistor R14 | 100 ohms |
| Resistor R15 | 4.3 kilo-ohms |
| Resistor R16 | 12 kilo-ohms |
| Resistor R17 | 1 kilo-ohm |
| Capacitor C1 | 100 microfarads |
| Capacitor C2 | 100 microfarads |
| Capacitor C3 | 0.1 microfarads |
| Capacitor C4 | 22 microfarads |
| Capacitor C5 | 100 microfarads |
| Capacitor C6 | .003 microfarads |
| Capacitor C7 | .068 microfarads |
| Diode D1 | 1N4002 |
| Diode D2 | 1S1 588 |
| Diode D3 | 1S1 588 |
| Diode D4 | 1N4002 |
| Diode D5 | 1S1 588 |
| NPN Transistor Q2 | 2SC1815(O) |
| NPN Transistor Q6 | 2SC1815(O) |
| NPN Transistor Q7 | 2SC1815(O) |
| NPN Transistor Q8 | 2SC367G(Y) |
| NPN Transistor Q9 | 2SD235(O) |
| PNP Transistor Q4 | 2SA1015(Y) |
| PNP Transistor Q5 | 2SA1015(Y) |
| SCR Q1 | N13T1 |
| SCR Q3 | N13T1 |

A 3 kilo-ohm variable resistor may be interposed between resistor R10 and the emitter of transistor Q5.

In the circuit of FIG. 4, transistors Q8 and Q9 form an audio signal driver amplifier for speaker 10; and transistors Q5, Q6 and Q7 form a tone generator oscillator which generates a pulsating variable frequency tone signal. The tone signal is amplified by amplifier Q8 and Q9 and applied to speaker 10 to cause the speaker to produce the usual siren alarm. This circuit is known, and it may be replaced by other known circuits to cause speaker 10 to produce other audible alarm sounds, as desired.

The oscillator circuit Q5, Q6 and Q7 is energized through a switching transistor Q4 which is rendered conductive when power is first applied to the right-hand terminals and which remains conductive for a predetermined time thereafter. This time may be set by potentiometer R2.

When power is first applied to the terminals, SCR Q1 is non-conductive and it remains non-conductive until the capacitor C2 charges to a predetermined level at which the SCR is fired and becomes conductive. So long as SCR Q1 is non-conductive transistor Q2 is non-conductive and SCR Q3 is non-conductive so that transistor Q4 is conductive.

However, when SCR Q1 becomes conductive, transistor Q2 becomes conductive and causes SCR Q3 to fire. When SCR Q3 becomes conductive the emitter of transistor Q4 is established at about the same potential as the base and the transistor Q4 becomes non-conductive.

The invention provides, therefore, an electrically-energized horn with a built-in device circuit which responds to an energizing condition to energize the horn for a pre-set time interval and automatically to de-energize the horn after the time interval has elapsed.

While a particular embodiment of the invention has been shown and described, modifications may be made, and it is intended in the claims to cover all such modifications which come within the true spirit and scope of the invention.

What is claimed is:

1. An electrically-energized horn comprising: a casing including a tubular portion at one end and an outwardly flared portion extending towards its other end; an acoustic conduit mounted in said casing coaxially with said tubular portion and having a throat facing said one end of said casing; a horn mounted in said casing and enclosing said acoustic conduit; a movable bobbin mounted in said casing adjacent to said throat of said conduit; electromagnetic means coupled to said bobbin for causing said bobbin to move reciprocally with respect to said throat, said electromagnetic means comprising magnetic means mounted in said tubular portion of said casing in coaxial relationship with said bobbin and an electric coil wound around said bobbin; a diaphragm mounted in said tubular portion to said casing and mechanically coupled to said bobbin; a printed circuit board mounted in said tubular portion adjacent to said one end of said casing and extending thereacross; and a solid state electronic circuit mounted on said circuit board in said tubular portion of said casing and electrically connected to said electric coil, said solid state electronic circuit including circuitry for supplying driving electric power to said electromagnetic means, and said electronic circuit including a timer network for cutting off the driving electric power to said electromagnetic means a predetermined time after the electronic circuit has been energized.

* * * * *